US008316922B2

(12) United States Patent
Katefidis

(10) Patent No.: US 8,316,922 B2
(45) Date of Patent: Nov. 27, 2012

(54) THERMAL POSTCOMBUSTION DEVICE AND METHOD FOR OPERATING THE SAME

(75) Inventor: Apostolos Katefidis, Gaertringen (DE)

(73) Assignee: Eisenmann AG (DE)

( * ) Notice: Subject to any disclaimer, the term of this patent is extended or adjusted under 35 U.S.C. 154(b) by 1098 days.

(21) Appl. No.: 11/658,528

(22) PCT Filed: Jul. 25, 2005

(86) PCT No.: PCT/EP2005/008065

§ 371 (c)(1),
(2), (4) Date: Sep. 25, 2008

(87) PCT Pub. No.: WO2006/010579

PCT Pub. Date: Feb. 2, 2006

(65) Prior Publication Data

US 2009/0007825 A1 Jan. 8, 2009

(30) Foreign Application Priority Data

Jul. 27, 2004 (DE) ..... 10 2004 036 326
Oct. 21, 2004 (DE) ..... 10 2004 051 491

(51) Int. Cl.
*F28G 11/00* (2006.01)

(52) U.S. Cl. ..... 165/95; 110/210

(58) Field of Classification Search ..... 122/379; 165/95; 110/214, 345, 203, 210; 34/514; 431/242; 423/245.3
See application file for complete search history.

(56) References Cited

U.S. PATENT DOCUMENTS 4,780,965 A * 11/1988 Grafen et al. ..... 34/35
4,983,362 A * 1/1991 Obermuller ..... 422/173
5,200,155 A * 4/1993 Obermueller ..... 422/182
5,397,548 A * 3/1995 Kritzler et al. ..... 422/173
5,538,420 A * 7/1996 Klobucar et al. ..... 432/2
5,643,544 A 7/1997 Henkelmann

FOREIGN PATENT DOCUMENTS

| | | |
|---|---|---|
| DE | 2134634 | 1/1973 |
| DE | 32 22 700 C1 | 11/1983 |
| DE | 36 26 218 A1 | 2/1987 |
| DE | 36 16 333 C1 | 4/1987 |
| DE | 195 21 673 | 12/1996 |
| EP | 0 560 678 A1 | 9/1993 |

* cited by examiner

*Primary Examiner* — Steven B McAllister
*Assistant Examiner* — John Bargero
(74) *Attorney, Agent, or Firm* — Factor Intellectual Property Law Group, Ltd.

(57) ABSTRACT

A thermal postcombustion device includes, in a conventional manner per se, a housing, having an inlet for the exhaust air that is to be purified and an outlet for clean air. A combustion chamber is located inside the housing, and inside this combustion chamber, a heating device generates a temperature at which the pollutants carried by the exhaust air burn. In order to reduce the energy requirement, a heat exchanger is provided over which the exhaust air coming from the inlet is guided to the combustion chamber, and the clean air coming from the combustion chamber is guided to the outlet. In order to also be able to process exhaust air, which is loaded with adherent residues, for example, pitch vapors, a device is provided with which, during a purification mode, at least a portion of the clean air can be optionally fed past a section of the heat exchanger located closer to the combustion chamber and into another section of the heat exchanger located further from the combustion chamber. Deposits, which have formed in the vicinity of the cold end of the heat exchanger, can be removed in this manner, particularly oxidized.

12 Claims, 7 Drawing Sheets

THERMAL POSTCOMBUSTION DEVICE AND METHOD FOR OPERATING THE SAME

RELATED APPLICATIONS

This application claims the filing benefit of PCT Patent Application PCT/EP2005/008065, filed Jul. 25, 2005; which claims the filing benefit of DE 102004036326.9, filed Jul. 27, 2004 and DE 102004051491.7, filed Oct. 21, 2004; of which the contents of these applications are incorporated herein by reference.

TECHNICAL FIELD

The invention relates to a thermal postcombustion device and a method for operating the same.

BACKGROUND OF THE INVENTION

Thermal postcombustion devices are used as standard in industry for exhaust air afterburning. At the same time, they are used for obtaining thermal energy which is contained in the pollutants carried by the exhaust air.

With known thermal postcombustion devices of the aforementioned type, only a limited disposal of air containing adherent residues is possible, as deposits form on the colder regions of the heat exchanger surfaces which, over a period of time, block up the heat exchanger or at least reduce the efficiency thereof. Shutting down the operation and costly cleaning operations are, therefore, required at regular time intervals.

SUMMARY OF THE INVENTION

It is, therefore, an object of the present invention to provide a thermal postcombustion device of the type described herein and a method for operating the same, with which such exhaust air, which contains the adherent residues in particular pitch vapours may be cleaned without substantially interrupting the operation.

This object is achieved by a thermal postcombustion device with a housing that has an inlet for exhaust air to be cleaned and an outlet for clean air; a combustion chamber arranged in the housing; a heating device generating the reaction temperature in the combustion chamber; a heat exchanger via which the exhaust air coming from the inlet is guided on the path to the combustion chamber and the clean air coming from the combustion chamber is guided on the path to the outlet; wherein a device is provided with which, in one cleaning mode, selectively at least one part of the clean air may be supplied past a section of the heat exchanger located closer to the combustion chamber, to a section of the heat exchanger more remote from the combustion chamber.

The thermal postcombustion device according to the present invention is constructed such that for cleaning, hot clean air may be applied to the regions of the heat exchanger particularly affected by deposits and which are more remote from the combustion chamber. The temperature thereof is, therefore, so high that the deposits are removed and/or oxidized from the heat exchanger surfaces. To this end, a temperature of 700° C. or more is required. During normal operation, at those points of the heat exchanger where deposits occur, the clean gas is no longer at this temperature. In order to reach the relevant temperature at the critical points, during cleaning mode the clean air leaving the combustion chamber bypasses a section of the heat exchanger, so that it is not cooled down in this section. If it is then introduced into the section of the heat exchanger affected by the deposits, it is thus still sufficiently hot in order to be able to remove the deposits.

The processing of the exhaust air is, therefore, permanently continued, even in the cleaning mode of the thermal postcombustion device; the only difference is that, during the relatively short times when a cleaning mode is performed, a slightly lower efficiency of the heat exchanger is tolerated.

In another aspect of the present invention in cleaning mode the heating of the section of the heat exchanger affected by deposits starts at its warmest end and then progresses in the direction of its coldest end. The cleaning process is completed when the region of the heat exchanger affected by deposits is brought to the required temperature and the deposits are removed.

In a further aspect of the invention, the section of the heat exchanger affected by the deposits is heated from its cold end. Thus deposits which are located closer to this cold end are reached more rapidly than in the embodiment of claim 2.

In a preferred aspect of the present invention, the section of the heat exchanger affected by deposits may be alternately or selectively heated from the warm end or from the cold end. In this manner, the shortest cleaning times may be achieved.

In a further aspect of the postcombustion device of the present invention, the section of the heat exchanger located closer to the combustion chamber comprises a plurality of heat exchanger pipes which enclose the combustion chamber; the section of the heat exchanger more remote from the combustion chamber is spatially separated from the section located closer to the combustion chamber and comprises a bundle of heat exchanger pipes; the two opposing ends of the sections of the heat exchanger are respectively connected by a connecting line, the through-flow of clean air through at least one connecting line being able to be controlled by a flap.

Additionally, a selective through-flow of the sections of the heat exchanger of the present invention affected by deposits in both directions may be achieved by Thermal postcombustion device according to Claim 5, characterised in that the connecting lines (33, 34; 133, 134) are connected to one another by a further connecting line (35; 135) in which a flap (37; 137) is located.

If the thermal efficiency of the thermal postcombustion device is to be maintained as high as possible, Device according to one of the preceding claims, characterised in that at least two further sections (250*b*, 250*b*') of the heat exchanger (250*a*, 250*b*, 250*b*') more remote from the combustion chamber (211) are provided which are arranged substantially parallel, the extent to which exhaust air and clean air are able to be supplied to the sections (250*b*, 250*b*') more remote from the combustion chamber (211) being able to be individually set for each further section (250*b*, 250*b*'). In this embodiment, because two sections of the heat exchanger which are more remote from the heat exchanger are available, one of these sections may be continually operated in normal mode. The second section located parallel thereto may, at the same time, be cleaned by a relatively small amount of gas, as a considerable amount of time is available for the cleaning process.

The aforementioned object, which relates to the method, is achieved by the invention specified in claim 8. The advantages of this method according to the invention correspond in a general sense to the aforementioned advantages of the thermal postcombustion device according to the invention. Method for operating a thermal postcombustion device which comprises: a housing which has an inlet for exhaust air to be cleaned and an outlet for clean air; a combustion chamber arranged in the housing; a heating device generating the reaction temperature in the combustion chamber; a heat exchanger via which the exhaust air coming from the inlet is guided on the path to the combustion chamber and the clean air coming from the combustion chamber is guided on the path to the outlet, characterised in that for cleaning the heat exchanger (50*a*, 50*b*; 150*a*, 150*b*; 250*a*, 250*b*, 250*b*') occasionally at least one portion of the hot clean air coming from the combustion chamber (11; 111; 211) may be supplied past a section (50*a*; 150*a*; 250*a*) of the heat exchanger (50*a*, 50*b*; 150*a*, 150*b*; 250*a*, 250*b*, 250*b*') located closer to the combustion chamber (11; 111; 211) to a section (50*b*; 150*b*; 250*b*, 250*b*') of the heat exchanger (50*a*, 50; 150*a*, 150*b*; 250*a*, 250*b*, 250*b*') more remote from the combustion chamber (11; 111; 211).

Furthermore, the addition of an additive, in particular a catalyst, the thermal effect of the hot clean air may assist in the removal of deposits and, in this manner, a shorter time may be achieved within which the thermal postcombustion device has to be operated in cleaning mode.

BRIEF DESCRIPTION OF THE FIGURES

Embodiments of the invention are described in more detail hereinafter with reference to the drawings, in which.

DETAILED DESCRIPTION OF THE PRESENT INVENTION

Figure 1:
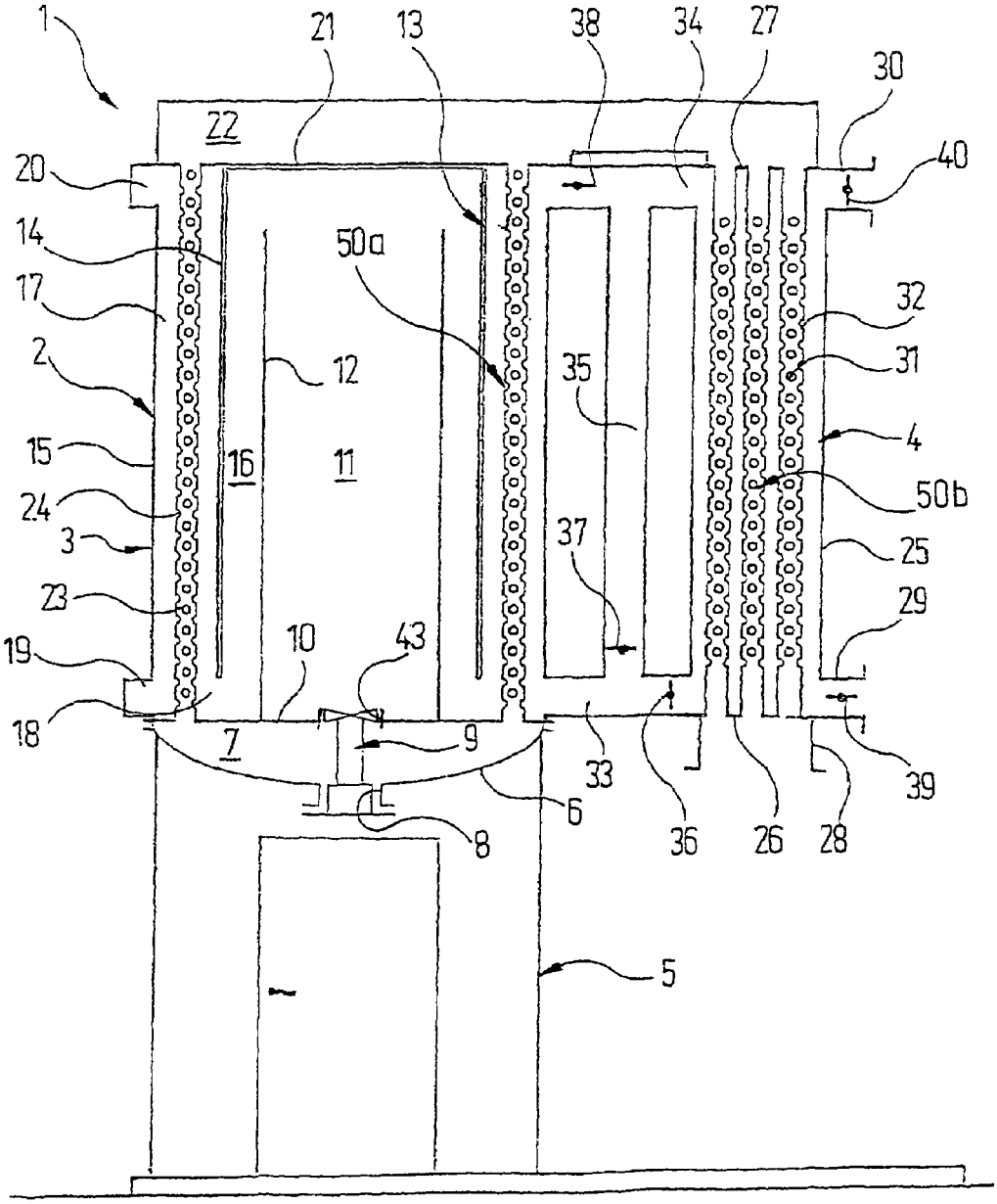
FIG. 1 is a vertical section through a first embodiment of a thermal postcombustion device in normal operation.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
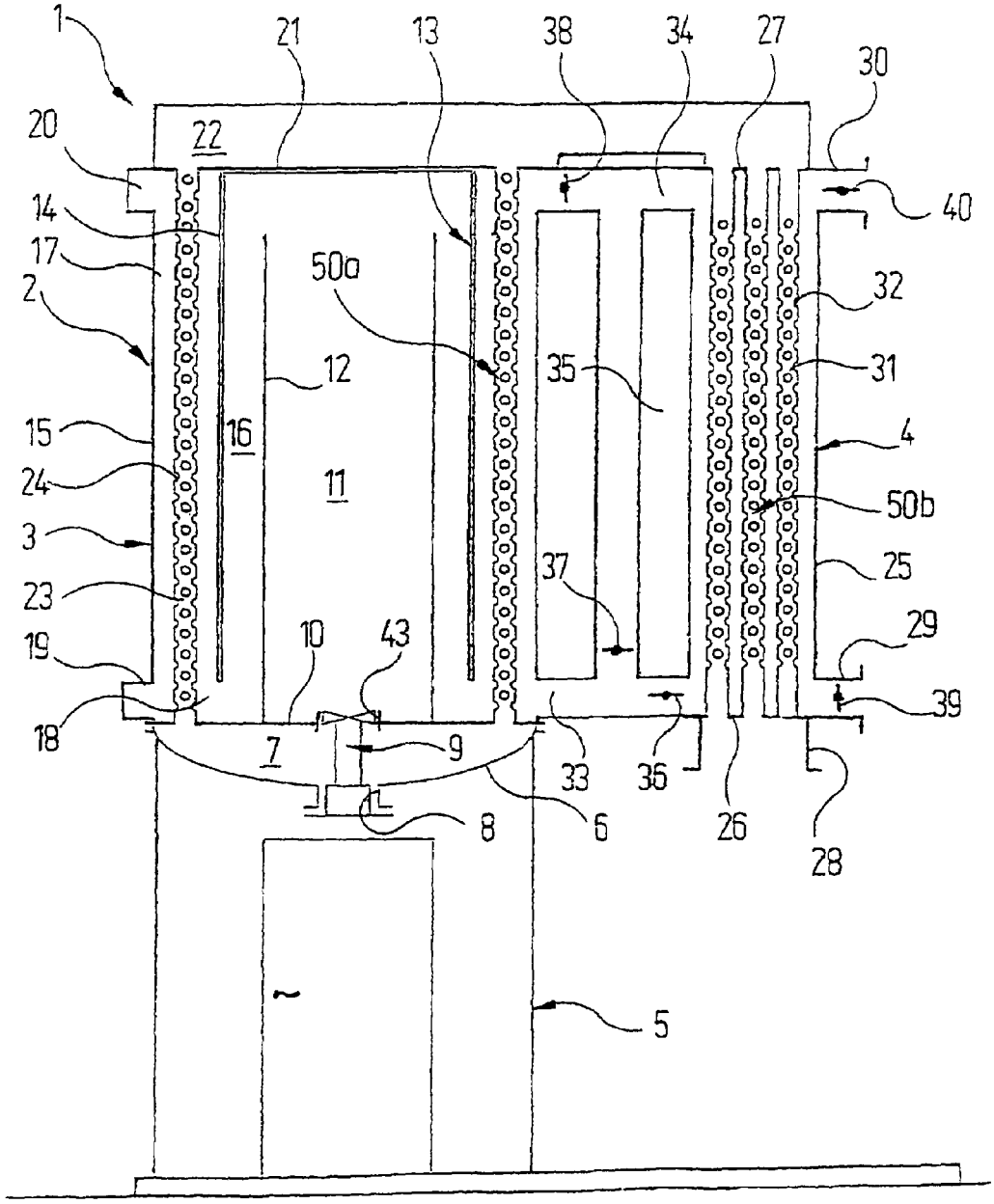
FIG. 2 is the thermal postcombustion device of FIG. 1 in a first cleaning mode.
Figure 3:
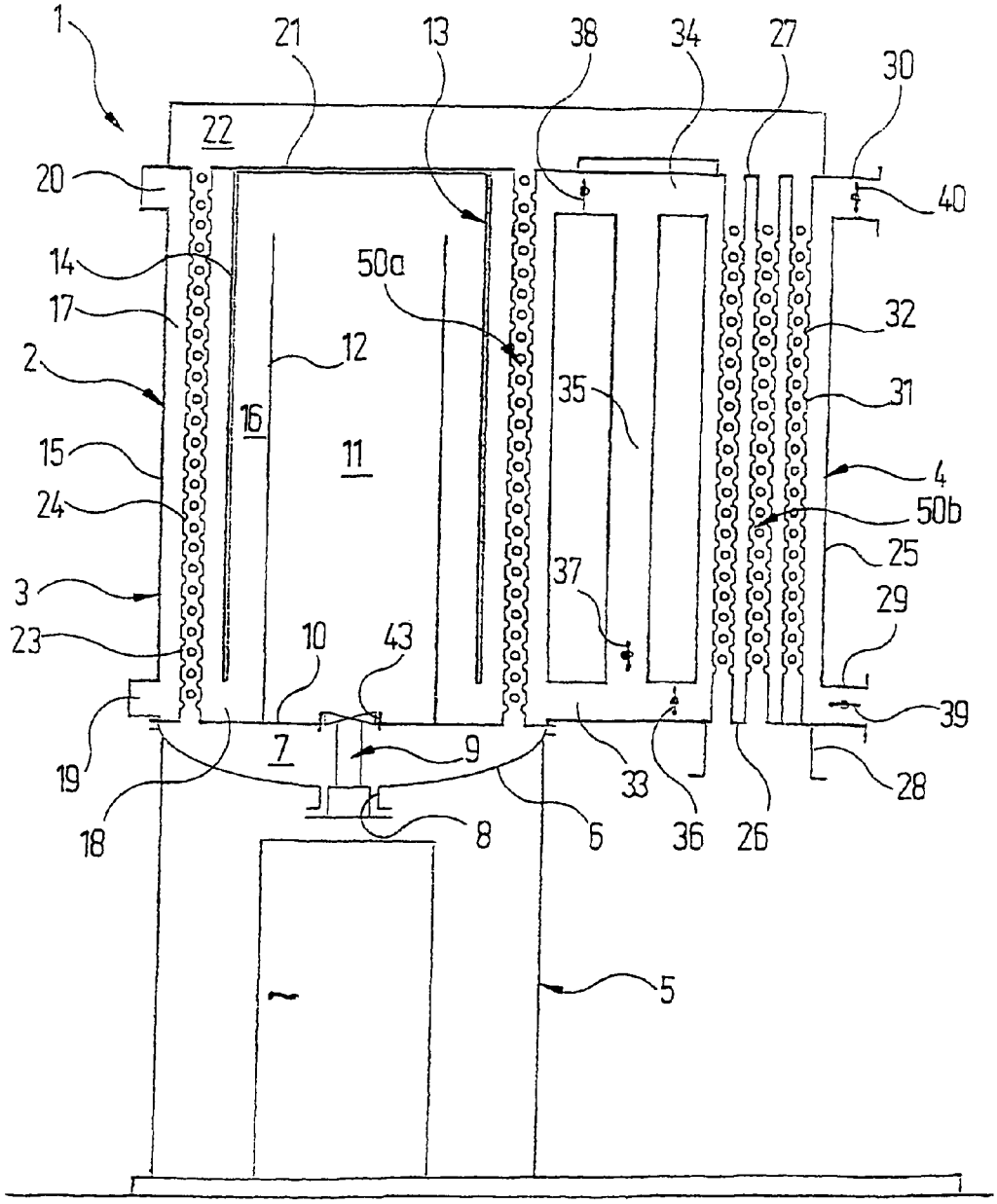
FIG. 3 is the thermal postcombustion device of FIGS. 1 and 2 in a second cleaning mode.

Reference is firstly made to FIGS. 1 to 3, in which a first embodiment of a thermal postcombustion device is shown. Said thermal postcombustion device is able to carry out self-cleaning in two different operating modes, in which deposits originating from the exhaust air to be cleaned, are able to be removed.

The thermal postcombustion device is identified as a whole by the reference numeral 1. It includes a housing 2, which is made up of a main housing 3, a secondary housing 4 and an accessible substructure 5. The accessible substructure 5 is arranged coaxially below the main housing 3, and bears the main housing 3 as well as the secondary housing 4 connected thereto.

The cover 6 of the substructure 5 is arched downwards and at the same time forms the base of a plenum 7. A burner 9 is passed through a central opening 8 of the base 6 of the plenum 7. The components required for operating the burner 9 and not shown separately in the drawings, in particular the electrical control lines and power supply lines, as well as the fuel supply lines, are accommodated in the substructure 5 and may be easily serviced therefrom.

The upper face of the plenum 7 is formed by a planar partition plate 10 which simultaneously serves as a base of a cylindrical combustion chamber 11. Said combustion chamber is delimited in the lateral direction by a cylindrical wall 12, and is open towards the top. The upper end of the burner 9 is inserted through an axial opening 43 in the partition plate 10 into the combustion chamber 11, so that the flame produced by the burner 9 burns within the combustion chamber 11.

The combustion chamber 11 is coaxially surrounded by a deflection insert 13 which has the form of a cup open towards the bottom. The cylindrical wall 14 of the deflection insert 13 terminates below at a distance from the partition plate 10. In this manner, between the cylindrical wall 12, the combustion chamber 11 and the cylindrical wall 15 of the main housing 3, two annular spaces are produced, namely an inner annular space 16 and an outer annular space 17 which are connected to one another at the bottom by an annular gap 18. At the upper end and lower end of the outer annular space 17 respectively one annular channel 19 and/or 20 is formed by a radial expansion of the cylindrical wall 5 of the main housing 3.

The outer annular space 17 is separated from an upper plenum 22 at the top by a second planar partition plate 21. In the embodiment shown, the upper partition plate 21 is moved over the deflection insert 13, but could also be attached as an annular plate to the base of the deflection insert 13.

The lower plenum 7 is connected to the upper plenum 22 by a plurality of heat exchanger pipes 23 located axially parallel on an imaginary cylindrical peripheral surface, which penetrate the outer annular space 17 and form a primary heat exchanger 50*a*. The heat exchanger pipes 23 are provided over the largest part of their axial extension with a plurality of surface textures 24, with which, in a manner which is not important here, allows the effective surface area of the heat exchanger pipes 23 to be enlarged.

The interior of the secondary housing 4 is delimited by a cylindrical wall 25, a lower planar partition plate 26 and an upper planar partition plate 27. It comprises a lower inlet pipe 28 extending coaxially to the cylindrical wall 25 for the exhaust air to be cleaned as well as one respective radially guided outlet pipe 29 and/or 30 for clean air on the upper end region and lower end region.

The interior of the secondary housing 4 is penetrated by a plurality of heat exchanger pipes 31 which together form a preheat exchanger 50*b* and connects the inlet pipe 28 to the upper plenum 22. This extends from the main housing 3 to above the secondary housing 4. The heat exchanger pipes 31 of the preheat exchanger 50*b* are provided with recesses 32 in a similar manner to the heat exchanger pipes 23 of the primary heat exchanger 50*b* inside the main housing 3.

The annular channels 19, 20 of the main housing 3 are respectively connected to the lower and/or upper end region of the interior of the secondary housing 4 by a connecting line 33 and/or 34. The two connecting lines 33, 34, in turn, communicate via a further connecting line 35 which extends substantially axially parallel.

In the lower connecting line 33 between the main housing 3 and the secondary housing 4, a first flap 36 is located and namely in that section which is located between the discharge point of the connecting line 35 and the secondary housing 4. The through-flow of the connecting line 35 may be controlled by a second flap 37; a third flap 38 is finally located in the upper connecting line 34 and namely between the upper annular channel 20 of the main housing 3 and the discharge point of the connecting line 35. Further flaps 39, 40 are respectively located in the two outlet pipes 29, 30 for clean air. All flaps 36 to 40 may be moved by motor or manually into any position between a fully closed position and a fully open position.

The above disclosed thermal postcombustion device 1 functions as follows:

During normal operation, the different flaps 36 to 40 adopt the positions shown in FIG. 1. This means that the flap 38 in the upper connecting line 34 between the upper annular channel 20 of the main housing 3 and the upper end region of the secondary housing 4 is fully open, as is the flap 39 in the lower outlet pipe 29 of the secondary housing 4 for clean gas. All other flaps 36, 37 and 40 are closed.

In these flap positions the following flow patterns result:

The exhaust air to be cleaned is supplied via the inlet pipe 28 and flows upwards through the preheat exchanger 50*b* formed by the heat exchanger pipes 31, thus reaching the upper plenum 22, and from there flows downwards out through the primary heat exchanger 50*a* formed by the heat exchanger pipes 23 in the main housing 3 into the lower plenum 7. From there, the exhaust air is blown into the combustion chamber 11 via the axial opening in the lower partition plate 10; the pollutants carried along start to oxidize at that point at the temperature generated by the burner 9.

The hot air flows over the upper edge of the cylindrical wall 12 of the combustion chamber 11 into the inner annular space 16, downwards inside said annular space and passes through the gap 18. By this time, at the latest, the oxidation of the pollutants is completed. From there, the hot air, now known as clean air, enters the outer annular space 17 and flows around the heat exchanger pipes 23 of the primary heat exchanger 50*a* located at that point on its path upwards into the upper annular channel 20. From the upper annular channel 20 the hot clean air flows past the open flap 38 through the upper connecting line 34 into the upper end region of the interior of the secondary housing 4, from there past the outer face of the heat exchanger pipes 31 to the lower outlet pipe 29 where it leaves the thermal postcombustion device 1 when the flap 39 is open, for further use and disposal.

With the illustrated through-passage of air through the thermal postcombustion device 1, a heat exchange process takes place twice between the exhaust air which is initially supplied cold and the hot clean air: the exhaust air is first heated in the preheat exchanger 50*b* which is formed by the heat exchanger pipes 31, by the hot clean air flowing in reverse flow. The exhaust air is further heated in the primary heat exchanger 50*a* formed by the heat exchanger pipes 23 in the main housing 3, so that the combustible pollutants contained therein are already close to their ignition temperature when reaching the lower plenum 7. The combustion of these pollutants is then assisted by the flame generated by the burner in the combustion chamber 11.

During this normal operation of the thermal postcombustion device 1, relatively cold exhaust gas enters the relatively cold heat exchanger pipes 31 via the inlet pipe 28, the temperature of said heat exchanger pipes rising from the bottom to the top. Depending on the pollutants carried by the exhaust air, said pollutants are able to be deposited on the inner walls of the heat exchanger pipes 31 and would block the through-passage through the heat exchanger pipes 31, if counter measures were not taken. To this end, it is possible to operate the disclosed thermal postcombustion device 1 in two different cleaning modes.

The first of these cleaning modes is shown in FIG. 2. It differs from the normal operating mode shown in FIG. 1 only by the position of different flaps: the flap 38 which is connected to the secondary housing 4 in the upper region of the main housing 3 is now closed; similarly, the lower outlet pipe 29 is blocked by a corresponding position of the flap 39. Instead of which, the connection between the main housing 3 and the secondary housing 4 is opened via the lower connecting line 33 by opening the flap 36; the flap 37 located in the connecting line 35 continues to remain closed.

The flow of the exhaust air to be cleaned through the heat exchanger pipes 31 of the preheat exchanger 50*b* in the secondary housing 4, through the upper plenum 22 and through the heat exchanger pipes 23 of the primary heat exchanger 50*a* in the main housing 3 into the lower plenum 7 as well as from there into the combustion chamber 11 and the combustion of pollutants there, remain unaltered. Due to the closure of the flap 38 in the upper connecting line 34, however, the hot combustion gases, i.e. the clean gases produced, are not able to flow upwards past the outer peripheral surfaces of the heat exchanger pipes 23 of the primary heat exchanger 50*a*, but enter at a relatively high temperature of approximately 700° C. via the lower connecting line 33 into the lower region of the interior of the secondary housing 4. They now flow in the interior of the secondary housing 4 past the peripheral surfaces of the heat exchanger pipes 31 located there, upwards to the upper outlet pipe 30 which they leave via the open flap 40.

Due to the high temperature which these clean gases have when entering the secondary housing 4, the deposits located on the inner peripheral surface of the heat exchanger pipes 31 are able to be removed, possibly oxidized and rinsed out by the air flowing through. Additives, for example catalysts, which are introduced into the exhaust air, may assist this process.

During this first cleaning mode, the operation of the thermal postcombustion device 1 does not, therefore, have to be interrupted. The exhaust air is cleaned, as before, but leaves the thermal postcombustion device 1 at a slightly higher temperature so that the thermal efficiency during the first cleaning mode is, therefore, slightly reduced. This may, however, be tolerated as the times in which it is necessary for the operation to be in cleaning mode, are relatively short. The cleaning mode may be interrupted as soon as the heat exchanger pipes 31 have reached the required temperature from bottom to top over their entire axial length, and the pollutants have been removed.

In order to shorten this time, the thermal postcombustion device 1 may be operated in a second cleaning mode, in which the flaps are positioned in the manner shown in FIG. 3.

The flap 38 in the upper connecting line 34 remains closed between the main housing 3 and the secondary housing 4. Now the upper outlet pipe 30 of the secondary housing 4 is blocked by corresponding closing of the flap 40, whilst the lower outlet pipe 29 is opened by opening the flap 39. The flap 36 in the lower connecting line 33 is moved into the closed position; instead of which the flap 37 is opened in the connecting line 35.

The only difference between the second cleaning mode shown in FIG. 3 relative to the first cleaning mode shown in FIG. 2, is that with the first, the hot clean air is introduced into the upper region of the interior of the secondary housing 4, and flows therein in reverse flow to the exhaust air flowing through the heat exchanger pipes 31. In this manner, the upper regions of the heat exchanger pipes 31 may be very effectively heated. The two cleaning modes of FIGS. 2 and 3 may be alternately operated intermittently, so that preferably the lower regions, and then further preferably the upper regions, of the heat exchanger pipes are alternately freed from deposits.

Figure 4:
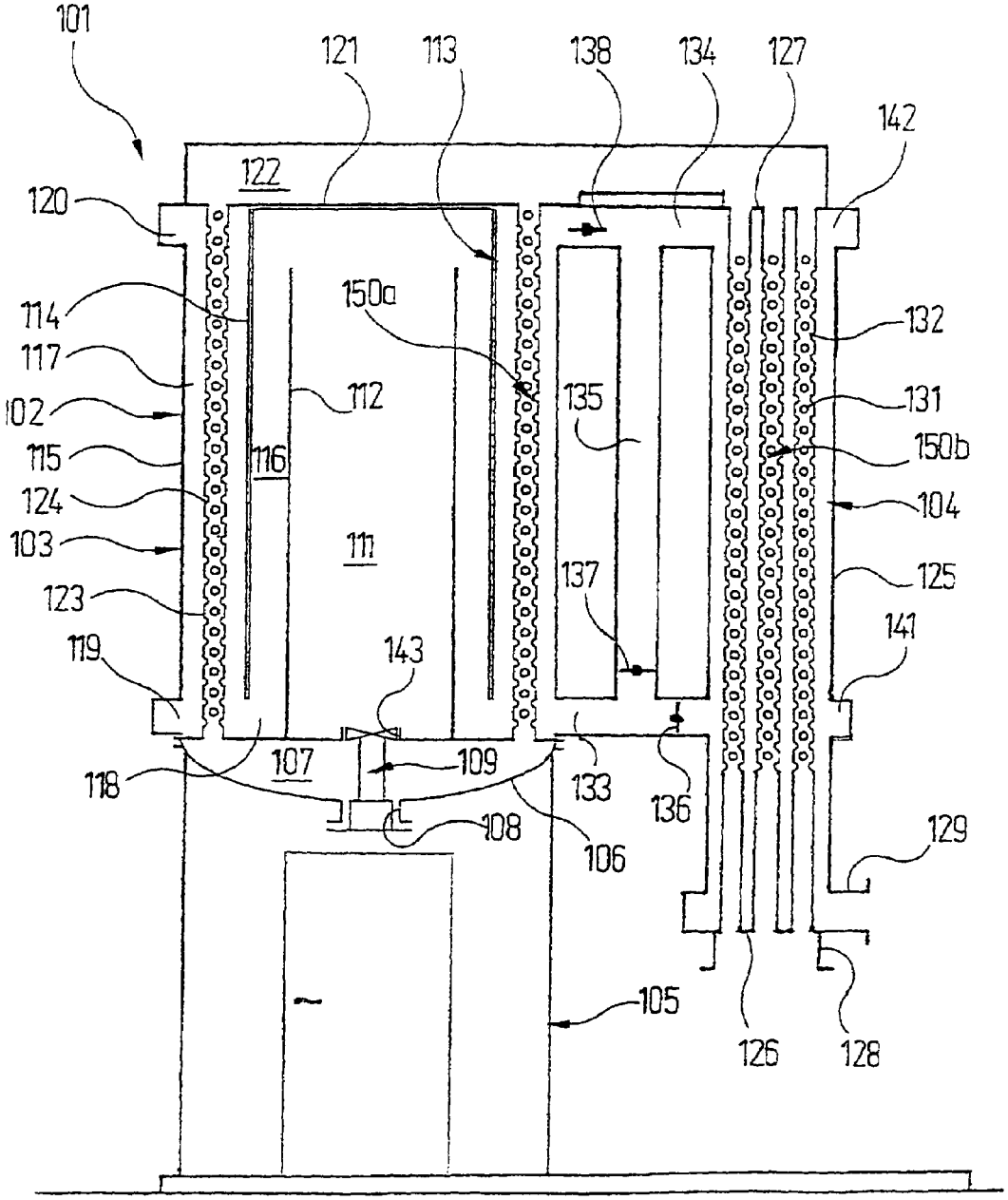
FIG. 4 is a vertical section through a second embodiment of a thermal postcombustion device in normal operation.
Figure 5:
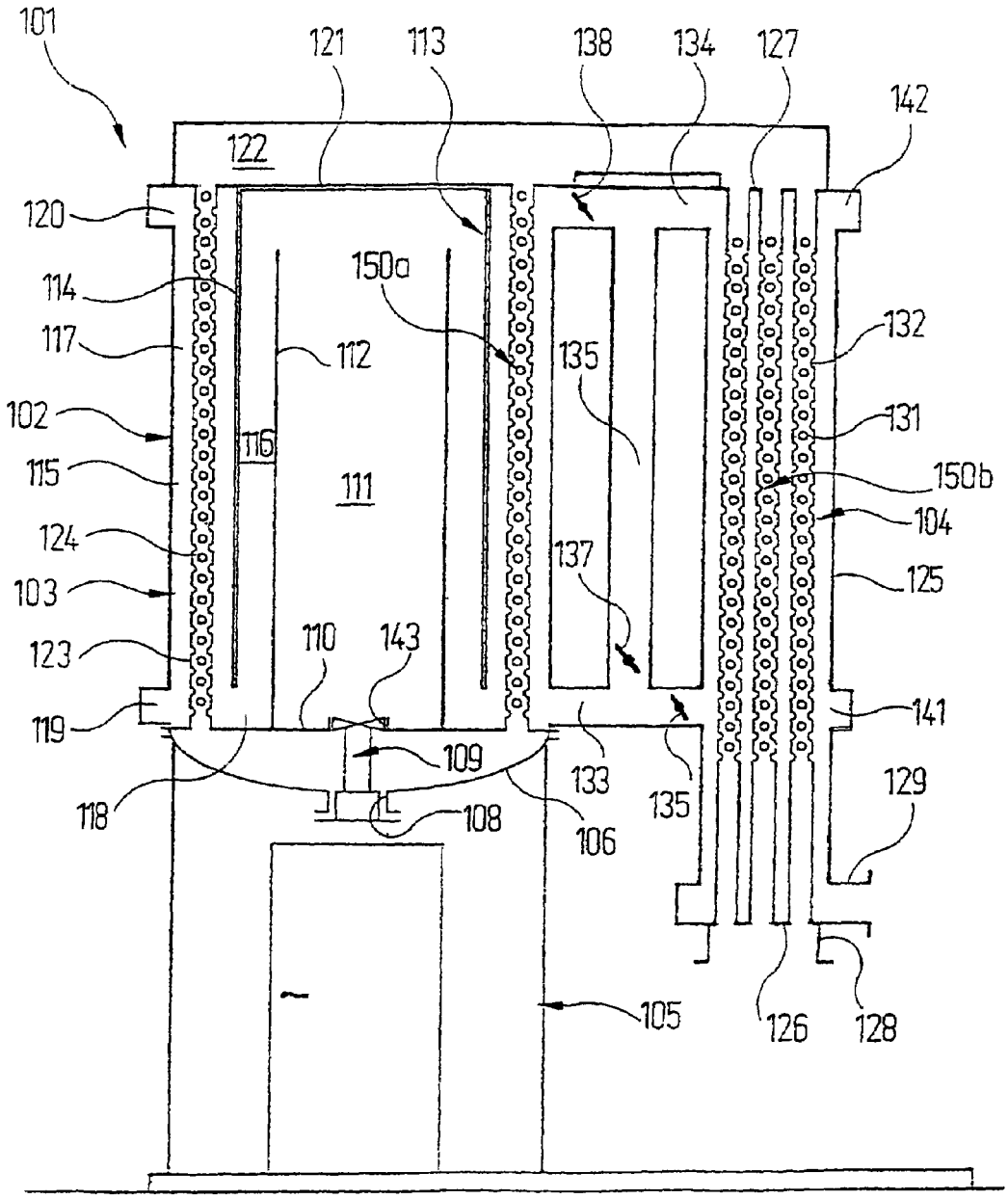
FIG. 5 is the thermal postcombustion device of FIG. 4 in cleaning mode.

The construction of the second embodiment shown in FIGS. 4 and 5 of a thermal postcombustion device substantially coincides with the embodiment which was disclosed above with reference to FIGS. 1 to 3. Corresponding parts are, therefore, identified with the same reference numerals, plus 100.

The construction of the main housing 103, the substructure 105 of the upper air plenum 122 and the connecting lines 133, 134, 135, together with the components contained therein, coincides entirely with the conditions shown in FIGS. 1 to 3. Differences between the two embodiments are only in the construction of the secondary housing 104. This has, as FIGS. 4 and 5 make clear, only one single lower outlet 129 for clean gas, in which however no controllable flap needs to be arranged. At the axial height at which the lower connecting line 133 and the upper connecting line 134 discharge into the interior of the secondary housing 104, annular channels 141, 142 extend which are formed by corresponding radial expansions of the secondary housing 104.

The mode of operation of the thermal postcombustion device 101 of FIGS. 4 and 5 during normal operation coincides entirely with that of the normal operation of the first embodiment (see FIG. 1) so that reference may be made to the above embodiments referring thereto.

To remove pollutants which have been deposited on the inner peripheral surfaces of the heat exchanger pipes 131 in the preheat exchanger 150*b*, the flaps 136, 137, 138 are displaced as is disclosed hereinafter.

For the explanation, it is firstly assumed that the flap 138 in the upper connecting line 134, as well as the flap 137 in the connecting line 135, is fully closed, whilst the flap 136 in the lower connecting line 133 is located in the fully open position. This flap position is not additionally illustrated for the second embodiment; it coincides entirely with the position of the flaps 36, 37, 38 in FIG. 2. In this case, the hot combustion air (clean air) flows over the lower connecting line 134 into the lower region of the interior of the secondary housing 104 and at that point along the lower region of the different heat exchanger pipes 131 downwards towards the outlet pipe 129.

It may be seen that both the primary heat exchanger 150*a* which is formed by the heat exchanger pipes 123, and the main part of the preheat exchanger 150*b* which is formed by the heat exchanger pipes 131 are, therefore, bypassed by the clean air. The clean air leaves the thermal postcombustion device 101 via the outlet pipe 129, i.e. at a relatively high temperature; the thermal postcombustion device 101 operates briefly at impaired thermal efficiency. In this flap position, substantially only the regions of the heat exchanger pipes 131 located below the lower annular channel 141 are cleaned. This is, however, sufficient in many cases, as due to the prevailing temperature conditions there is the greatest risk of depositing pollutants at this point.

The thermal postcombustion device 101 of FIGS. 4 and 5 may also be operated in a mixed operation between normal mode and cleaning mode, as is shown in FIG. 5. In this mixed operation, the flaps 136, 137, 138 are in an intermediate position between the fully open and the fully closed positions. The self-cleaning effect may be set according to the degree of opening of the individual flaps: the more firmly the flap 138 in the upper connecting line 134 is closed, the more hot clean gases bypass the primary heat exchanger 150*a* formed by the heat exchanger pipes 123 and are therefore able to be used for cleaning purposes.

By the position of the flaps 136 and 137 it is determined which parts of the hot clean air diverted for cleaning purposes is respectively supplied to the upper region of the interior of the secondary housing 104 and the lower region of the interior of the secondary housing 104. The more hot clean gas supplied to the upper region, the more rapidly that temperature is reached in the upper region on the heat exchanger pipes 131 which is required there for removing the pollutants from the inner peripheral surfaces of the heat exchanger pipes 131. The more hot gases supplied to the upper region of the interior of the secondary housing 104, the greater the efficiency of the preheat exchanger 150*b* formed by the heat exchanger pipes 131.

If necessary, the position of the different flaps 136, 137, 138 may also be continually altered during operation of the thermal postcombustion device 101, as required by the respective conditions. An interruption to the operation of the thermal postcombustion device 101 for cleaning the preheat exchanger 150*b* is required as infrequently as in the embodiment of FIGS. 1 to 3; the loss of thermal efficiency which is unavoidable during the cleaning operation, may however be easily tolerated.

Figure 6:
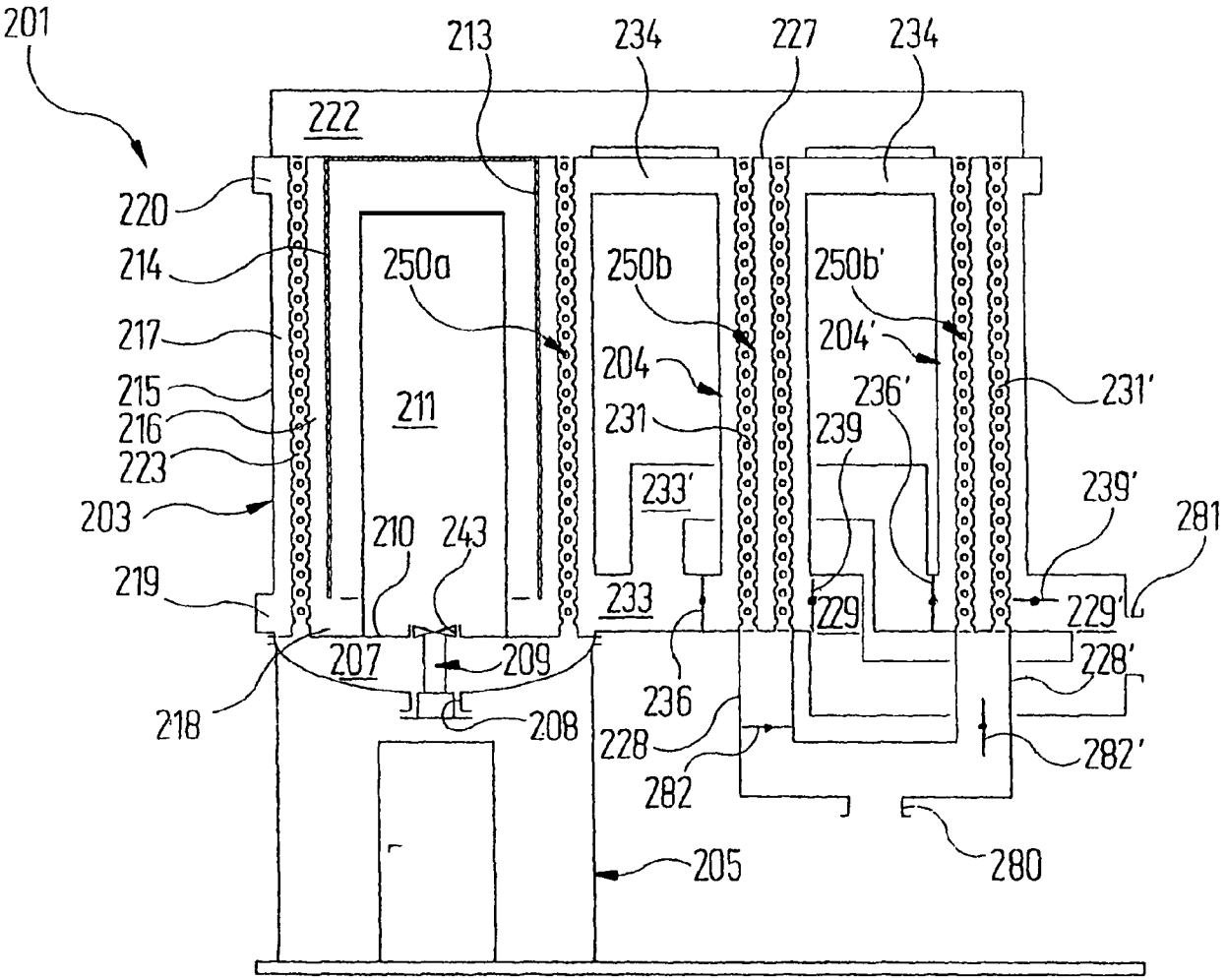
FIG. 6 is a vertical section through a third embodiment of a thermal postcombustion device in normal mode.
Figure 7:
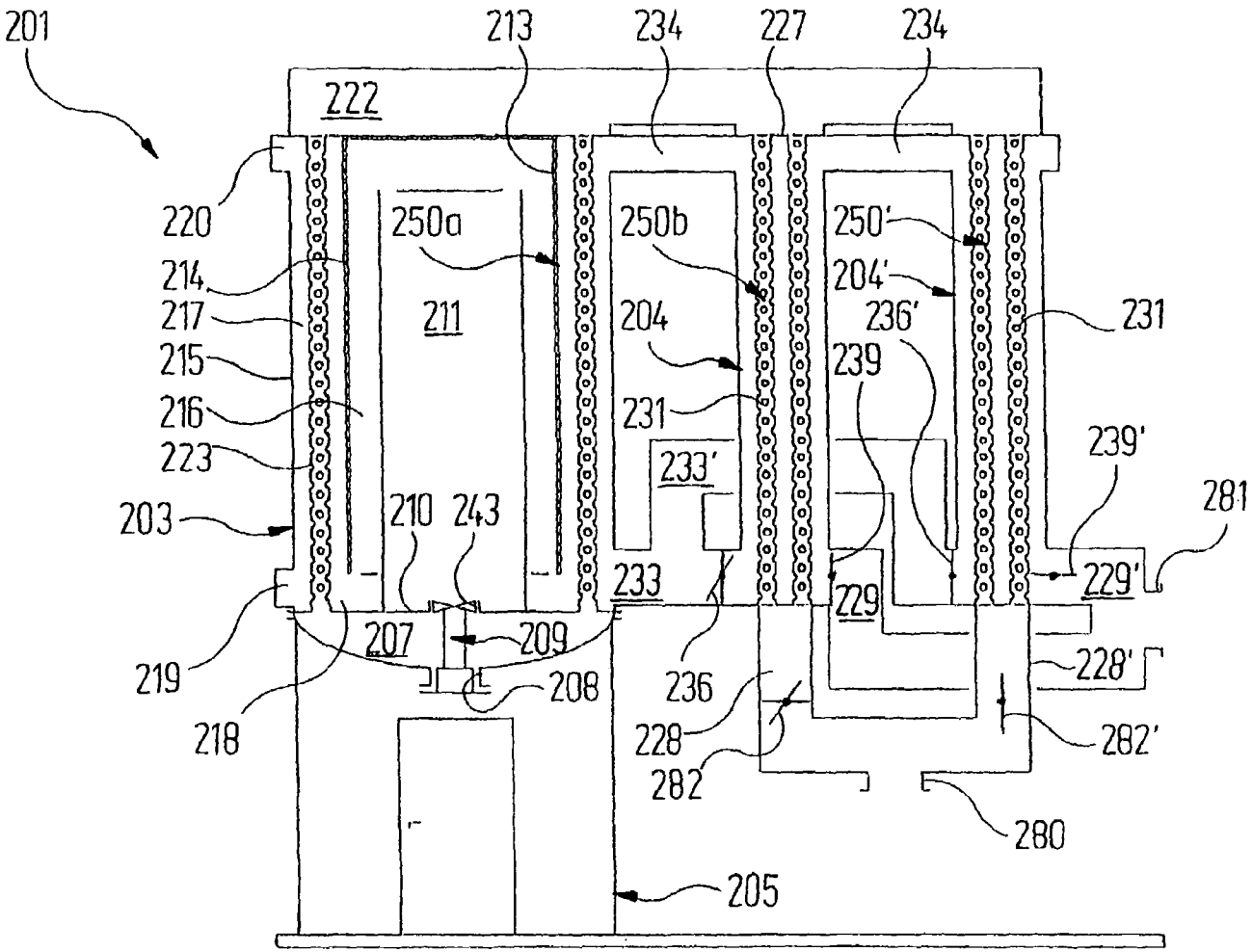
FIG. 7 is the thermal postcombustion device of FIG. 6 in a mixed operating mode.

In the embodiments disclosed above with reference to FIGS. 1 to 5, the efficiency of the thermal postcombustion device is reduced during the cleaning mode, as already mentioned. Thus it is desirable to keep the installation in cleaning mode for as short a time as possible. Insofar as a reduction of the thermal efficiency is not tolerated or it is desired to be kept as low as possible, this is possible with the embodiment of the thermal postcombustion device which is shown in FIGS. 6 and 7. This embodiment corresponds substantially to those of FIGS. 1 and 2, so that reference is made to the above description of these figures, and subsequently substantially the differences between the embodiment of FIG. 1 and that of FIGS. 6 and 7 are disclosed. Corresponding parts of the embodiment of FIGS. 6 and 7 are identified by the same reference numerals as in FIGS. 1 and 2, plus 200.

Unchanged relative to the embodiment of FIGS. 1 and 2, in FIGS. 6 and 7 is the main housing 203 which is borne by a substructure 205, the lower plenum 207, the burner 209, which generates a flame in a cylindrical combustion chamber 211, the deflection insert 213, the upper plenum 222 and the heat exchanger pipes 223 connecting the lower plenum 207 to the upper plenum 222, which form a primary heat exchanger 250*a*. In the embodiment of FIGS. 6 and 7, however, not only one preheat exchanger 250*b* is associated with the primary heat exchanger 250*a*, but two preheat exchangers 250*b*, 250*b'* are provided which, in principle, are positioned parallel to one another, and, as is disclosed hereinafter in detail, may be operated alternately in different operating modes. The two preheat exchangers 250*b* and 250*b'* are of substantially identical construction. To differentiate between the reference numerals, those which are provided respectively with a', are those which belong to the second preheat exchanger 250*b'*.

As in the embodiment of FIGS. 1 and 2, in the embodiment of FIGS. 6 and 7 the main housing 203 is connected to the lower inner region of the secondary housing 204 by a lower connecting line 233, in which a flap 236 is located. From the lower connecting line 233 a further connecting line 233' branches off which leads to the second secondary housing 204' of the second preheat exchanger 250*b'*. The inlet of the connecting line 233' into the second secondary housing 204' is governed by a flap 236'.

The main housing 203 is, in turn, connected by an upper connecting line 234 to the upper inner region of the first secondary housing 204, which now, however, is extended further as far as the upper inner region of the second secondary housing 204'. Other than in the embodiment of FIGS. 1 and 2, however, in that of FIGS. 6 and 7 there is no flap in the upper connecting line 234.

The interiors of the two secondary housings 204 and 204', are respectively penetrated by a plurality of axially parallel heat exchanger pipes 231, 231', which extend from an inlet pipe 228, 228' of the respective preheat exchanger 250*b*, 250*b*' as far as the upper plenum 222, which in the embodiment of FIGS. 6 and 7 is guided over the first secondary housing 204 as far as the second secondary housing 204'. The two inlet pipes 228, 228' respectively contain a motorized flap 282, 282' and are connected to a main inlet pipe 280 via which the exhaust air to be cleaned of the thermal postcombustion device 201 is supplied.

The two secondary housings 204, 204' have one respective outlet 229, 229' for the clean air, in which a motorized flap 239, 239' is located. The two outlets 229, 229' of the two secondary housings 204, 204' are connected to a main outlet pipe 281 via which the clean air is removed.

For the description of the mode of operation of the third embodiment of a thermal postcombustion device 201, reference is firstly made to FIG. 6. This shows the position of the different flaps in an operating mode, in which the second preheat exchanger 250*b*' operates in normal mode and the first preheat exchanger 250*b* is at a standstill. To this end, all flaps 236, 239 and 282 associated with the first preheat exchanger 250*b* are closed. The flap 236' leading to the lower end region of the interior of the second secondary housing 204' is also closed whilst the flaps 282' and 239' are open.

In these flap positions, the exhaust air to be cleaned flows via the inlet pipe 228' into the heat exchanger pipes 231' of the second preheat exchanger 250*b*' via the upper plenum 222 through the heat exchanger pipes 223 of the primary heat exchanger 250*a*, through the lower plenum 207 into the combustion chamber 211, where the combustion of pollutants is initiated, via the annular spaces 216, 217 along the outer surfaces of the heat exchanger pipes 223 and then via the upper connecting line 234 into the interior of the second secondary housing 204'. From there the clean gas flows past the outer surfaces of the heat exchanger pipes 231' of the second preheat exchanger 250*b*', via the open flap 239' to the main outlet pipe 281.

If, instead of the second preheat exchanger 250*b*', the first preheat exchanger 250*b* is to be used in normal mode, the flap positions of the two preheat exchangers 250*b* and 250*b*' are thus easily reversed in a similar manner. In principle, it is also possible to operate both preheat exchangers 250*b* and 250*b*' with a corresponding flap position, simultaneously in normal mode.

Henceforth it is assumed that the first preheat exchanger 250*b* has been operational for a certain time and is to be cleaned. With an unchanged position of the flaps 236', 239', 282' associated with the second preheat exchanger 250*b*', the positions of the flaps 236, 239 and 282 associated with the first preheat exchanger 250*b* are altered to such an extent as is shown in FIG. 7.

The flap 282 located in the inlet pipe 228 of the first preheat exchanger 250*b* is slightly opened, as is the flap 236 determining the supply of clean air from the main housing 203. This has the following consequences for the gas flows:

The entire exhaust air is no longer supplied to the second preheat exchanger 250*b*', but a certain portion of the exhaust air also reaches the preheat exchanger 250*b* depending on the degree of opening of the flap 282. The portion of exhaust air deflected into the preheat exchanger 250*b* should be kept as small as possible in order to keep the total efficiency of the thermal postcombustion device 201 as high as possible. Whilst the flow paths for that part of the exhaust air which flows through the second preheat exchanger 250*b*', remain unaltered, the flow conditions are altered in the first preheat exchanger 250*b* as follows:

By means of the partially open flap 236, a corresponding amount of clean air enters the lower end region of the interior of the first secondary housing 204 at a temperature of approximately 700° C. Said clean air flows past the outer surfaces of the heat exchanger pipes 231 of the first preheat exchanger 250*b* and heats up said heat exchanger pipes. Exhaust air simultaneously flows through the inner pipe of said heat exchanger pipes 231 and which exhaust air passes through the flap 282 in the inlet pipe 228. These flow patterns may be maintained for a very long time, as the second preheat exchanger 250*b*' continues to operate in normal mode. A small amount of hot clean air which flows into the interior of the first secondary housing 204 via the flap 236, may over time heat the walls of the heat exchanger pipes 231 of the first heat exchanger, therefore, to such a high temperature, for example approximately to 700° C., that combustion of the pollutants deposited on the inner peripheral surfaces of the heat exchanger pipes 231 is possible. So much exhaust air is passed through the inner pipe of the heat exchanger pipes 231 that the amount of oxygen necessary for combusting the deposits is available.

The exhaust air flowing through the heat exchanger pipes 231 of the first preheat exchanger 250*b* and carrying the combusted deposits, is mixed with the exhaust air in the upper plenum 222 which comes from the second preheat exchanger 250*b*' and is then supplied therewith for combustion in the combustion chamber 211.

The third embodiment of the thermal postcombustion device 201 allows a particularly variable mode of operation, depending on to what extent the flaps 236, 236', 239, 239' and 282, 282' which determine the flow of gas through the two preheat exchangers 250*b*, 250*b*' are opened. Thus the following principles apply:

The larger the amounts of air, which are supplied via the preheat exchangers 250*b*, 250*b*' which are respectively in cleaning mode, the shorter the duration of the cleaning mode is able to be maintained. The total efficiency of the thermal postcombustion device 201 is, however, all the lower at this time. In contrast, the less air supplied through the preheat exchanger 250*b*, 250*b*' which is in cleaning mode, however, the longer the cleaning mode lasts; the total efficiency of the thermal postcombustion device is, however, only slightly impaired. As, generally, sufficient time is available, it is in principle to be preferred to supply as little air as possible to the preheat exchanger 250*b*, 250*b*' in cleaning mode.

If the functions of the preheat exchanger 250*b*, 250*b*' which is in cleaning mode and the preheat exchanger in the normal mode are to be exchanged, this occurs via a short intermediate state in which the two preheat exchangers 250*b*, 250*b*' are operated in normal mode.

The invention claimed is:

1. A thermal postcombustion device comprising:

a) a housing which has an inlet for exhaust air to be cleaned and an outlet for cleaned air further partitioned into a main housing and a secondary housing;

b) a combustion chamber arranged in the main housing;

c) a heating device generating a reaction temperature in the combustion chamber;

d) a heat exchanger in the main housing comprising a plurality of heat exchanger pipes which enclose the combustion chamber;

e) a preheat exchanger, located in the secondary housing more remote from the combustion chamber than the heat exchanger and spatially separated from the heat exchanger and being interconnected with the heat exchanger by at least one connecting line, communicatively controlled by a flap, via which the exhaust air to be cleaned coming from the inlet passes through the preheat exchanger then through the heat exchanger and is guided on a path to the combustion chamber and the cleaned air coming from the combustion chamber is guided on a path to the outlet; wherein f) an apparatus is provided with which, in a first cleaning mode, selectively at least a part of the cleaned air, at a temperature of at least 700 degrees Celsius, bypasses of the heat exchanger and is supplied directly from the combustion chamber to the preheat exchanger so that adherent residues, which are deposited by the exhaust air in the preheat exchanger, can be removed without interrupting the cleaning of the exhaust air to be cleaned.

2. The thermal postcombustion device of claim 1, wherein the cleaned air flows through the section of the heat exchanger in an opposite direction of the exhaust air to be cleaned.

3. The thermal postcombustion device of claim 1, wherein the cleaned air flows through the heat exchanger in a same direction as the exhaust air to be cleaned.

4. The thermal postcombustion device of claim 1, wherein the cleaned air flows through the section of the heat exchanger either in an opposing direction or in a same direction as the exhaust air to be cleaned and wherein the housing further comprises a second outlet, and both outlets being selectively openable outlets and wherein each outlet communicates with one end of the preheat exchanger.

5. The thermal postcombustion device according to claim 1, wherein the at least one connecting line is connected to by a further connecting line in which the flap is located.

6. The thermal postcombustion device of claim 1, further comprising a second preheat exchanger substantially parallel to the first preheat exchanger so that, the exhaust air to be cleaned is supplied to one of the preheat exchangers and the cleaned air is supplied to the other preheat exchanger.

7. A method for operating a thermal postcombustion device, a) a housing which has an inlet for exhaust air to be cleaned and an outlet for cleaned air, and further comprising a main housing and a secondary housing;

b) a combustion chamber arranged in the main housing;

c) a heating device generating a reaction temperature in the combustion chamber;

d) a heat exchanger located in the main housing comprising a plurality of heat exchanger pipes which enclose the combustion chamber; and, e) a preheat exchanger, located in the secondary housing and more remote from the combustion chamber than the heat exchanger and spatially separated from the heat exchanger and to the heat exchanger by at least one connecting line communicatively controlled by a flap, via which the exhaust air to be cleaned coming from the inlet is guided on a path to the combustion chamber and the cleaned air coming from the combustion chamber is guided on a path to the outlet, wherein during cleaning of the preheat exchanger at least one portion of the cleaned air coming from the combustion chamber at a temperature of at least about 700 degrees Celsius bypasses and is supplied to the preheat exchanger so that adherent residues deposited in the preheat exchanger by the exhaust air to be cleaned, can be removed without interrupting the cleaning of the exhaust air to be cleaned;

cleaning the exhaust air to be cleaned while cleaning the adherent residues deposited in the preheat exchanger.

8. The method of claim 7, wherein during cleaning of the preheat exchanger, the cleaned air flows through the preheat exchanger in an opposite direction to the exhaust air to be cleaned.

9. The method of claim 7, wherein during cleaning of the preheat exchanger, the cleaned air flows through the preheat exchanger in a same direction as the exhaust air to be cleaned.

10. The method of claim 7, wherein during cleaning of the preheat exchanger, the cleaned air flows through the preheat exchanger alternately in an opposite direction and in a same direction as the exhaust air to be cleaned.

11. The method of claim 7, wherein for cleaning of the preheat exchanger, an additive is added into the heat exchanger.

12. The method of claim 11, wherein the additive is a catalyst.

* * * * *

UNITED STATES PATENT AND TRADEMARK OFFICE

CERTIFICATE OF CORRECTION

PATENT NO. : 8,316,922 B2
APPLICATION NO. : 11/658528
DATED : November 27, 2012
INVENTOR(S) : Apostolos Katefidis It is certified that error appears in the above-identified patent and that said Letters Patent is hereby corrected as shown below:

| | |
|---|---|
| Claim 1 at Col. 11, line 11 | After the word "bypasses" the word "of" should be deleted. |
| Claim 2 at Col. 11, line 18 | After the words "through the" the words "section of the" should be deleted. |
| Claim 7 at Col. 11, line 39 | After the word "device" the word -- "comprising" -- should be inserted. |

Signed and Sealed this
Twenty-ninth Day of January, 2013

David J. Kappos

David J. Kappos
*Director of the United States Patent and Trademark Office*